US007100406B2

(12) United States Patent
Masseth, Jr.

(10) Patent No.: US 7,100,406 B2
(45) Date of Patent: Sep. 5, 2006

(54) LOCKING MECHANISM FOR A SAFE DOOR

(75) Inventor: James E. Masseth, Jr., Henrietta, NY (US)

(73) Assignee: John D. Brush & Co., Inc., Rochester, NY (US)

( * ) Notice: Subject to any disclaimer, the term of this patent is extended or adjusted under 35 U.S.C. 154(b) by 130 days.

(21) Appl. No.: 10/823,896

(22) Filed: Apr. 14, 2004

(65) Prior Publication Data

US 2004/0206140 A1 Oct. 21, 2004

Related U.S. Application Data

(60) Provisional application No. 60/463,828, filed on Apr. 18, 2003.

(51) Int. Cl.
*E05B 13/00* (2006.01)
*E05B 13/08* (2006.01)
*E05B 55/00* (2006.01)

(52) U.S. Cl. ..... 70/210; 70/153; 70/329; 70/333 R; 109/59 R

(58) Field of Classification Search ..... 70/128–130, 70/133, 134, 323, 327, 333 R, 210, 301, 70/303 A, 302, 303 R, 153; 109/45, 58, 109/64, 58.5, 59 R, 63.5; 292/39, 22, 40, 292/41, 27, 33, 34–37
See application file for complete search history.

(56) References Cited

U.S. PATENT DOCUMENTS

| | | | | |
|---|---|---|---|---|
| 430,072 | A * | 6/1890 | Dowd | 70/118 |
| 599,277 | A * | 2/1898 | Wise | 70/302 |
| 1,240,403 | A * | 9/1917 | Amato | 70/118 |
| 3,250,100 | A * | 5/1966 | Vittorio | 70/141 |
| 4,468,943 | A * | 9/1984 | Beattie et al. | 70/302 |
| 5,341,752 | A * | 8/1994 | Hambleton | 109/59 R |
| 5,778,708 | A * | 7/1998 | Crosby et al. | 70/118 |
| 6,679,087 | B1 * | 1/2004 | Suggs et al. | 70/153 |

* cited by examiner

*Primary Examiner*—Brian E. Glessner
*Assistant Examiner*—William Schrode
(74) *Attorney, Agent, or Firm*—Jaeckle Fleischmann & Mugel, LLP

(57) ABSTRACT

A locking mechanism that allows a live bolt lock plate and a primary vertical lock plate to move relative to one another irrespective of the plates connection with a drive mechanism is provided. The drive mechanism includes first and second gears and is used to move the locking mechanism between locked and unlocked positions. The live bolt lock plate has a slot defined therein and is engaged with the first gear of the drive mechanism. The primary lock plate is engaged with the second gear of the drive mechanism and has a guide pin mounted thereon. The guide pin is positioned within the slot to slidingly couple the live bolt lock plate and the primary lock plate, in addition to their connection with the drive mechanism. A tumbler stack is associated with the primary lock plate for selectively allowing the primary locking plate to be moved to the unlocked position.

35 Claims, 6 Drawing Sheets

LOCKING MECHANISM FOR A SAFE DOOR

CROSS-REFERENCE TO RELATED APPLICATIONS

This application claims the benefit of U.S. Provisional Application No. 60/463,828, filed on Apr. 18, 2003.

STATEMENT REGARDING FEDERALLY SPONSORED RESEARCH OR DEVELOPMENT

Not applicable.

BACKGROUND OF THE INVENTION

This invention relates to a locking mechanism for a safe door. In particular, this invention relates to a locking mechanism that includes a vertical lock plate and a live bolt lock plate that are coupled to one another in such a way that movement of one of the plates causes movement of the other plate irrespective of whether the plates are coupled with a drive mechanism.

Mechanisms for locking safe doors are well known in the art. One of these locking mechanisms generally includes a drive gear, a live bolt lock plate coupled with at least one locking pin, a primary vertical lock plate, and a tumbler stack. The drive gear operates to couple the live lock bolt plate with the primary vertical lock plate and is the principal mechanism for moving the plates relative to one another. In particular, as the drive gear is rotated, the live bolt lock plate moves along a linear path to engage and disengage the locking pins with the safe housing, and the primary vertical lock plate moves in a direction that is perpendicular to the movement of the live bolt lock plate when the notches in the tumbler stack are aligned. When the notches in the tumbler wheel are not aligned, the primary vertical lock plate is not permitted to move, thereby preventing the drive gear from moving the live bolt plate and locking pins to an unlocked position.

The use of the drive gear as the primary mechanism for coupling and moving the live bolt lock plate and the primary vertical lock plate relative to one another presents a number of drawbacks and deficiencies. For instance, an unauthorized attempt to open the safe door may be made by bypassing the locking mechanism. One way to bypass the lock mechanism is to displace the drive gear in such a way so that the drive gear is no longer aligned with the primary vertical lock plate. When the drive gear is no longer in alignment with the vertical lock plate and the drive gear is rotated, the primary vertical lock plate will not move since the drive gear and vertical lock plate are no longer engaged. At this point, the live bolt lock plate may be manipulated in such a way to disengage the locking pins from the safe housing without having to worry about whether the tumbler stack will permit the primary vertical lock plate to move into an unlocked position. In other words, the primary vertical lock plate and the tumbler stack no longer play an active part in locking the safe since they are not connected with the drive gear and the live lock bolt plate.

Accordingly, there exists a need for a locking mechanism where the live bolt plate and primary vertical lock plate are coupled together in such a way where movement of one plate causes movement in the other plate regardless of whether the drive gear is engaged with both of the plates. The present invention fills these needs as well as other needs.

BRIEF SUMMARY OF THE INVENTION

In order to overcome the above stated problems and limitations there is provided a locking mechanism for a safe or other type of enclosure that ensures that the live bolt lock plate and the primary vertical lock plate will move relative to one another, even if the drive mechanism is not connected to both plates. By providing a slidable connection between both of the plates that is independent of their connection of the drive gear, the locking mechanism of the present invention reduces or substantially eliminates the possibility of avoiding the tumbler stack or other security mechanism on the safe by moving or otherwise manipulating the drive gear so that it is not engaged with both plates.

In general, the locking mechanism may include a drive mechanism, a live bolt lock plate, a primary lock plate, and a tumbler stack. The drive mechanism has first and second gears and is used to move the locking mechanism between locked and unlocked positions. The live bolt lock plate is engaged with the first gear of the drive mechanism and has at least one locking pin mounted thereto for selectively engaging a door and a housing. The live bolt lock plate also has a slot defined therein. The primary lock plate is engaged with the second gear of the drive mechanism and has a guide pin mounted thereon. The guide pin is slidingly positioned within the slot to couple the live bolt lock plate and the primary lock plate to one another. The tumbler stack may be used with a combination or keyed lock and associated with the primary lock plate for selectively allowing the primary locking plate to be moved to the unlocked position. The live bolt lock plate and the primary lock plate are slidingly coupled to one another, wherein the movement of one of the plates causes movement of the other plate irrespective of the connection of the live bolt lock plate and the primary lock plate to the drive mechanism.

Additionally, the locking mechanism may include a tail piece having an extension plate and an engagement flange. The extension plate may be coupled with the primary lock plate and the engagement flange may be coupled with the extension plate and adapted to be associated with the tumbler stack. Furthermore, the locking mechanism may further include a rod mounted to the door, wherein an aperture is formed in one of the live bolt lock plate and the primary lock plate, the aperture being sized to slidably receive the rod. It will be understood that the slot may be positioned at an angle of about 45 degrees relative to the aperture. Moreover, the drive mechanism may include a third gear that is coupled with a secondary lock plate. The primary and secondary lock plate are each coupled with at least one locking pin for selectively engaging the door with the housing.

Additional objects, advantages and novel features of the present invention will be set forth in part in the description which follows, and will in part become apparent to those in the practice of the invention, when considered with the attached figures.

BRIEF DESCRIPTION OF THE SEVERAL VIEWS OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
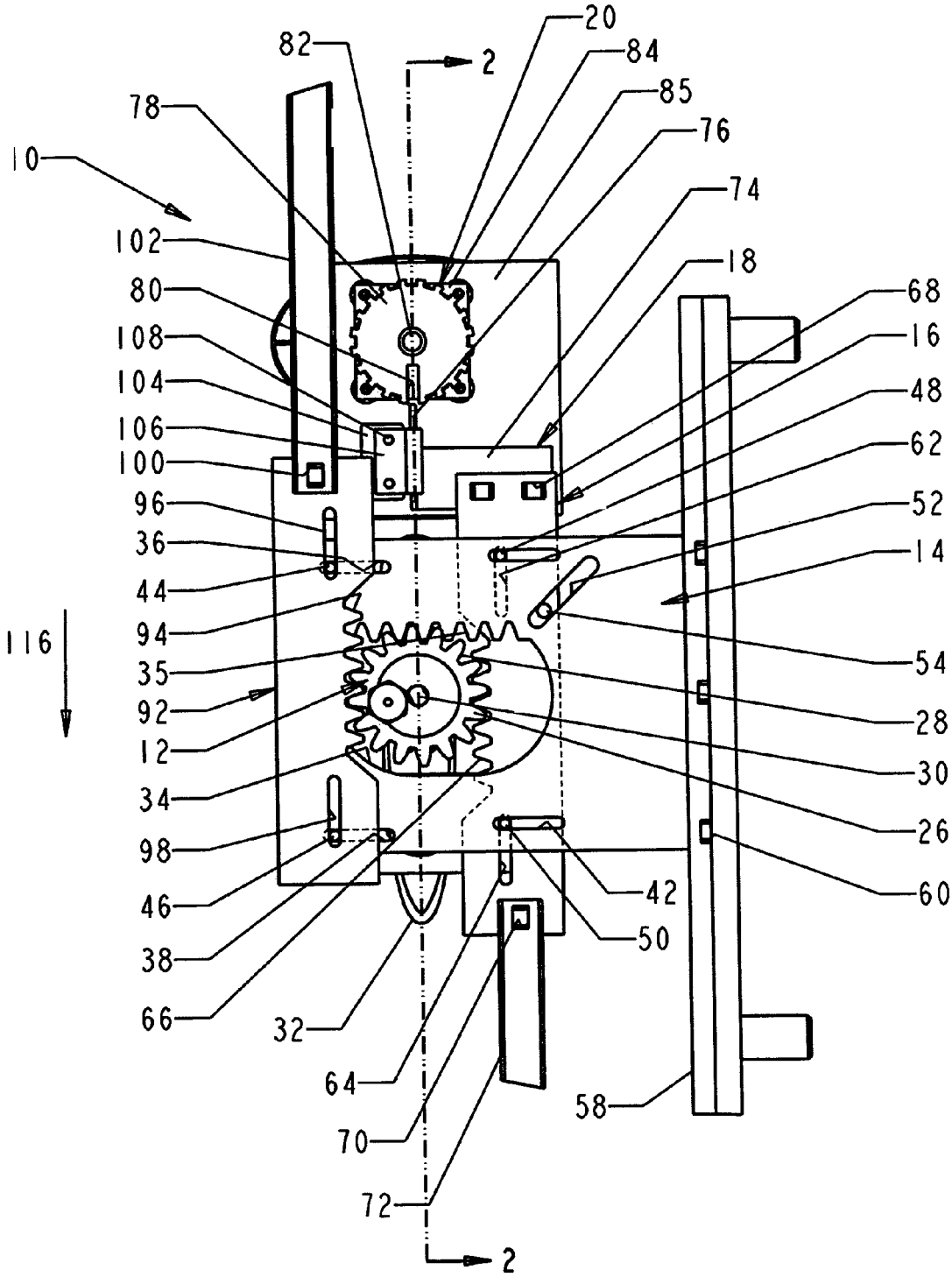
FIG. 1 is a rear elevational view of a locking mechanism mounted to the interior wall of a safe door according to the present invention.

Referring now to the drawings in detail, and initially to FIG. 1, reference numeral 10 generally designates a locking mechanism constructed in accordance with a first embodiment of the present invention. In general, locking mechanism 10 includes a drive mechanism 12, a live bolt lock plate 14, a primary vertical lock plate 16, a tail piece 18 and a tumbler stack 20. The components of locking mechanism 10, which will be described in more detail below, are mounted to a safe door and operate to selectively engage or disengage one or more locking pins with a main housing of the safe.

Figure 2:
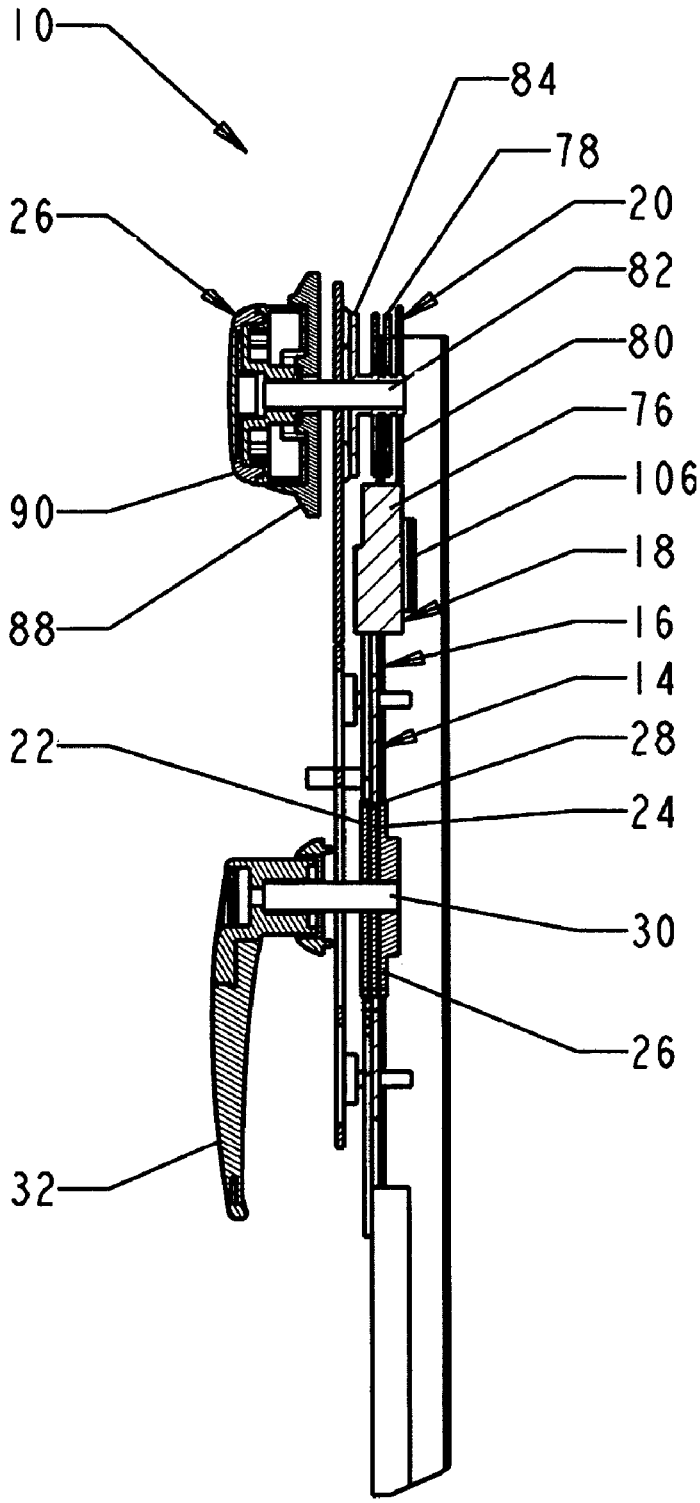
FIG. 2 is a cross-sectional view taken along line 2—2 of FIG. 1 showing the locking mechanism of the present invention.

As best seen in FIGS. 1 and 2, drive mechanism 12 includes a set of drive gears 22, 24, 26 that are located in the interior portion of the safe wall. Each of drive gears 22, 24, 26 include a plurality of teeth 28 that extend radially therefrom. In addition, drive gears 22, 24, 26 are coupled with one another by a spindle 30, which is adapted to extend through the safe door. A handle 32 is fixedly mounted to the distal end of spindle 30 and may be used to selectively rotate drive gears 22, 24, 26 about the longitudinal axis of spindle 30.

Figure 6:
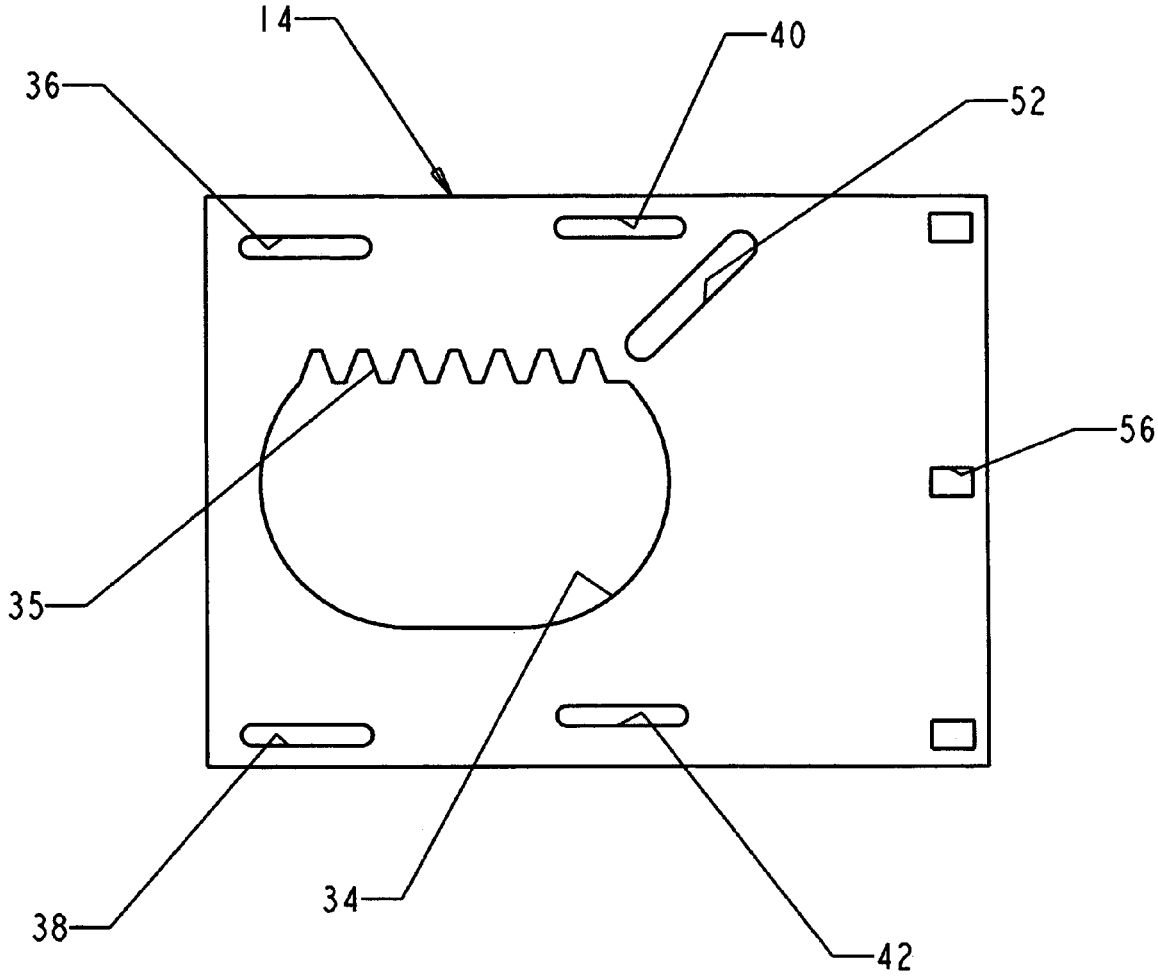
FIG. 6 is a plan view of the live bolt lock plate having a slot defined therein according to the present invention.

As best seen in FIGS. 1, 2, and 6, a center aperture 34 is defined in live bolt lock plate 14 and is sized so that drive mechanism 12 can fit therein. In particular, a portion of center aperture 34 has one or more teeth 35 formed therein that are adapted to mesh with teeth 28 formed in gear 24. A plurality of perimeter apertures 36, 38, 40, 42 are formed on live bolt lock plate 14, which are adapted to be slidably connected with rods 44, 46, 48, 50, respectively. It will be understood that rods 44, 46, 48, 50 may be fixedly coupled with the interior portion of the safe door. Furthermore, in accordance with the present invention, a slot 52 is defined in live bolt lock plate 14 may be positioned at an angle relative to perimeter apertures 36, 38, 40, 42. In particular, slot 52 may be positioned at an angle of about 45 degrees relative to perimeter apertures 36, 38, 40, 42. Slot 52 is adapted to slidably receive a guide pin 54, which will be discussed in more detail below. As best seen in FIGS. 1 and 6, live bolt lock plate 14 also includes one or more connection locations 56 that represents an area where live bolt lock plate 14 is coupled with a side locking bar 58. Side locking bar 58 extends along the edge of the safe door and serves as the mounting location for the one or more locking pins 60 that are used to selectively engage the safe door with the safe housing.

Figure 5:
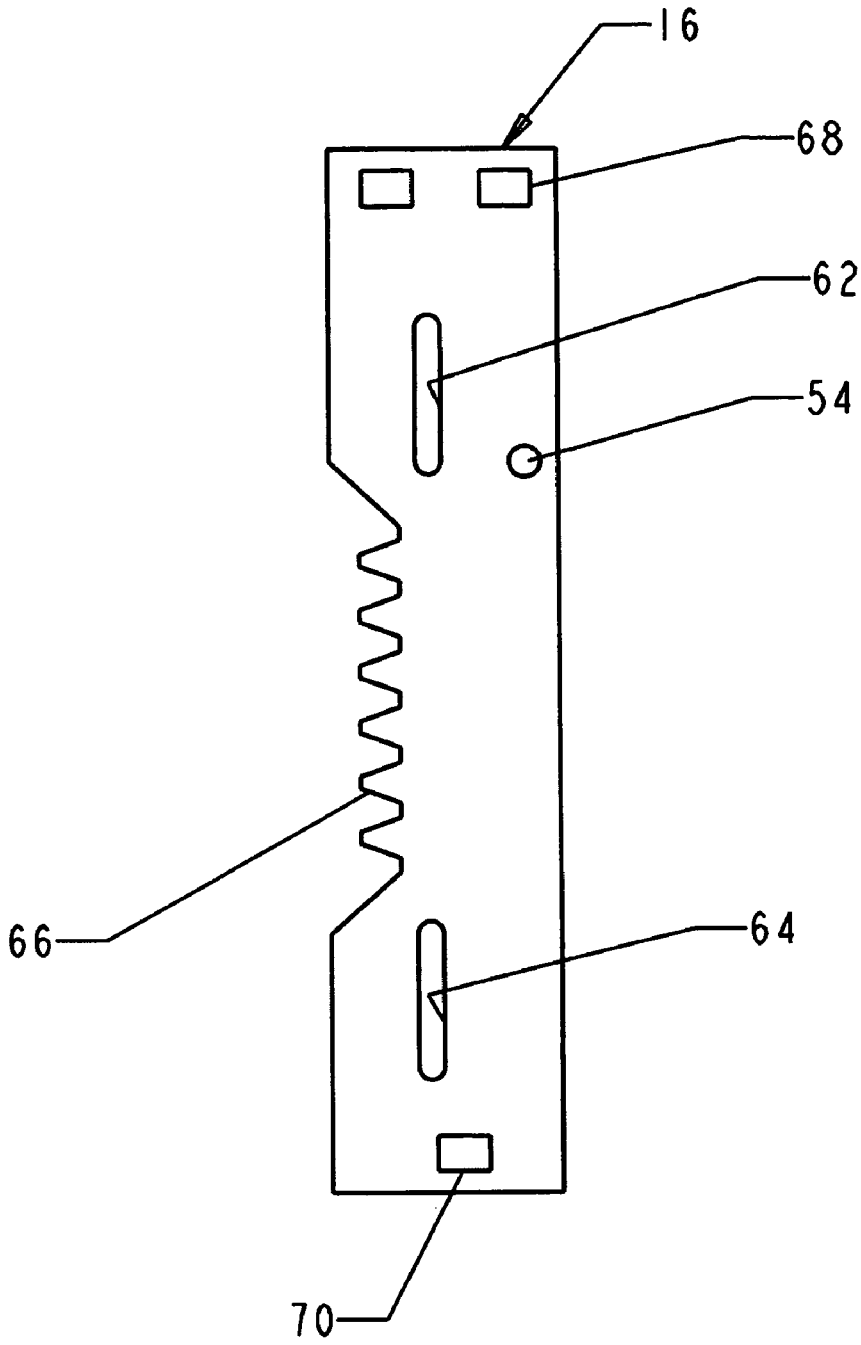
FIG. 5 is a plan view of the primary vertical lock plate having a guide pin extending therefrom according to the present invention.

As best seen in FIGS. 1 and 5, primary vertical lock plate 16 includes a pair of apertures 62, 64 defined therein that are adapted to be slidably coupled with rods 48, 50 respectively. A plurality of teeth 66 are formed in the side of primary vertical lock plate 16 and operate to mesh with teeth 28 on drive gear 26. In accordance with the present invention, guide pin 54 extends from the surface of primary vertical lock plate 16 and may be slidably received within slot 52. Thus, guide pin 54 and slot 52 operate to couple live bolt lock plate 14 with primary vertical lock plate 16 so that they are operationally dependant upon one another regardless of whether they are connected with drive mechanism 12. It is also within the scope of the present invention to utilize other mechanisms such as, but not limited to, a track fastening system, that operate to couple live bolt lock plate 14 and primary vertical lock plate 16 with one another so that the movement of one of the locking plates causes movement in the other plate. The use of the slot 52 and guide pin 54 in locking mechanism ensures that the live bolt lock plate 14 and primary vertical lock plate 16 will move relative to one another, even if drive mechanism 12 is not connected to both plates 14, 16. Furthermore, it will also be understood that pin 54 may also extend from live bolt lock plate 16 and slot 52 may be defined in primary vertical lock plate 16 in a similar fashion as described above.

Primary vertical lock plate 16 also includes at least one top connection location 68 and at least one bottom connection location 70. As best seen in FIG. 1, bottom connection location 70 may be connected to a lower locking arm 72. Lower locking arm 72 may be coupled with a lower locking pin, not shown, to engage the bottom of the safe door with the safe housing. Further, top connection location 68 may be used to fixedly couple tail piece 18 with primary vertical lock plate 16.

As best seen in FIGS. 1 and 2, tail piece 18 includes a plate 74 and an engagement flange 76 that are connected with primary vertical lock plate 16. Engagement flange 76 that may extend outwardly from plate 74 at a distance beyond the top edge of plate 74. Further, engagement flange 76 is configured to interact with tumbler stack 20, or similar combination or keyed locking device, to allow live bolt lock plate 14 and primary vertical lock plate 16 to move to an unlocked position.

As best seen in FIGS. 1 and 2, tumbler stack 20 may include one or more tumbler wheels 78 each having a notch 80 formed therein. Each of the tumbler wheels 78 are rotatably coupled with a dial spindle 82 and secured to the interior wall of the safe door by a base 84 and a mounting plate 85. Dial spindle 82 extends through the safe door and is fixedly coupled with a combination dial 86, which may include a partial cover 88, a knob 90 and other structural components. Tumbler stack 20 operates to allow tumbler wheels 78 to be aligned when a certain combination is entered with combination dial 86. It will be understood and appreciated that other types of locks may be utilized with the present invention to allow live bolt lock plate 14 and primary vertical lock plate 16 to move relative to one another to unlock the safe door.

As best seen in FIG. 1, locking mechanism 10 may also include a secondary vertical lock plate 92 when implementing additional locking pins to engage both the top and bottom portions of the safe door with the safe housing. Specifically, one or more teeth 94 may be formed in a side edge of secondary vertical lock plate 92 to mesh with teeth 28 of drive gear 26. Secondary vertical lock plate 92 also includes a pair of apertures 96, 98 adapted to be slidably engaged with rods 44, 46, respectively. Moreover, a connection location 100 is positioned on secondary vertical lock plate 92 to allow an upper locking arm 102 to be fixedly coupled therewith. Upper locking arm 102 may in turn be coupled with a locking pin to engage the top of the safe door with the safe housing.

As best seen in FIGS. 1 and 2, an extension plate 104 and U-shaped channel 106 may be connected to an upper portion of the secondary vertical locking plate 92. U-shaped channel 106 is coupled with extension plate 104 by a pair of fasteners 108 so that the channel 106 is positioned around a at least a portion of engagement flange 76.

Figure 3:
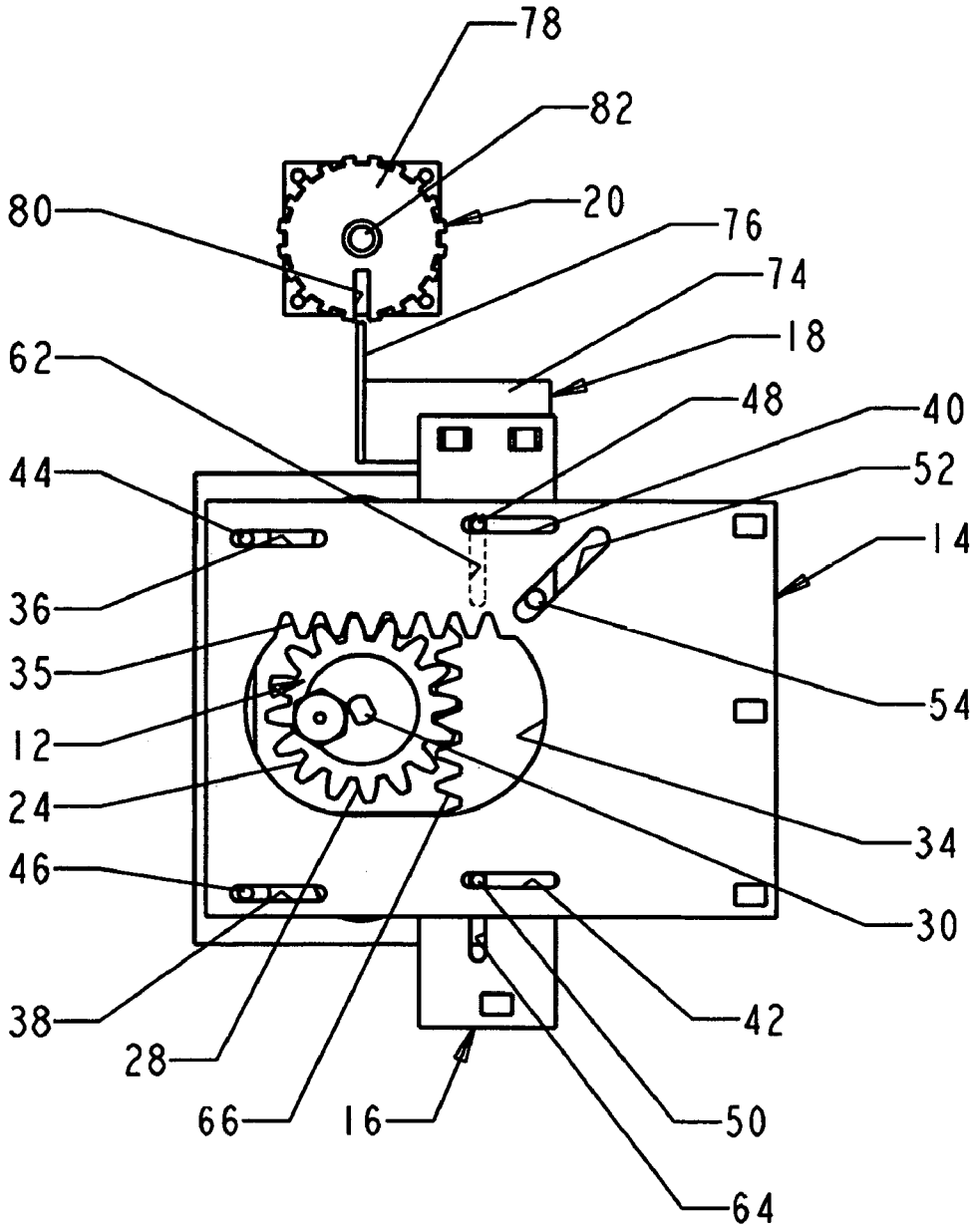
FIG. 3 is a rear elevational view of a portion of the locking mechanism in a locked position including a drive gear, a live bolt lock plate, a primary vertical lock plate, a tail piece and a tumbler stack.
Figure 4:
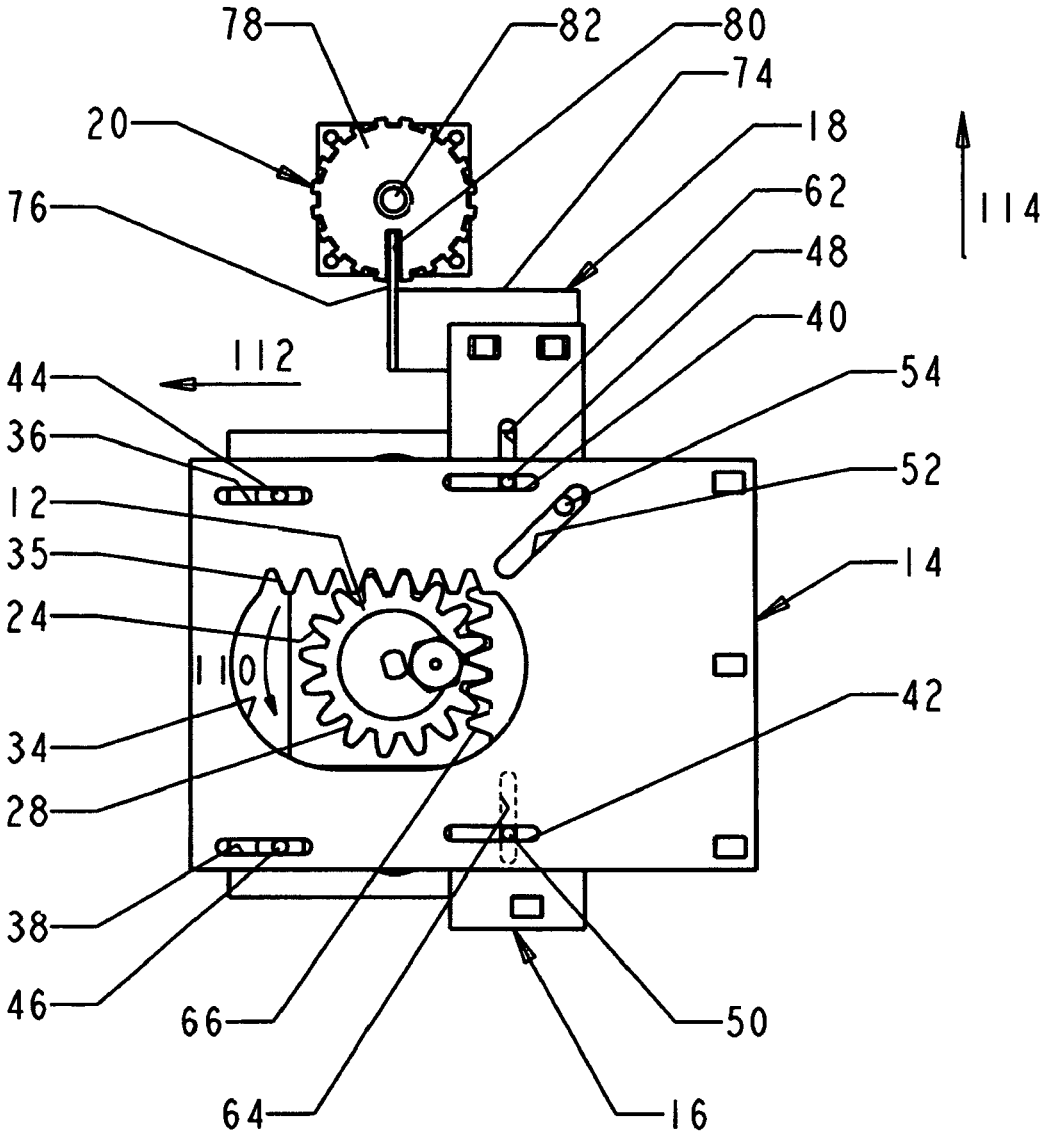
FIG. 4 is a rear elevational view similar to FIG. 3 showing a portion of the locking mechanism in an unlocked position.

Locking mechanism 10 may be moved between a locked position, as best seen in FIG. 3, and an unlocked position, as best seen in FIG. 4. In the locked position, the wheels 78 in the tumbler stack 20 are arranged so that notches 80 are misaligned with flange 76. The misalignment of notches 80 will prevent flange 76 from engaging tumbler stack 20 and will merely come into contact with the peripheral edge of tumbler wheels 78. Live bolt lock plate 14 is positioned so that locking pins 60 extend outwardly from the safe door and engage the safe housing establishing the locked position. In particular, bolts 44, 46, 48, 50 are positioned toward the left portion of each perimeter aperture 36, 38, 40, 42, respectively. Guide pin 54 that extends from primary vertical lock plate 16 is slidably positioned toward a lower portion of slot 52. Further, rods 48, 50 are also positioned within upper portions of apertures 62, 64 defined in primary vertical lock plate 16.

As best seen in FIG. 1, if the safe is equipped with locking pins that extend from the bottom portion of the safe door, lower locking arm 72 may be positioned in such a manner to extend from the bottom edge of the safe door and engage the safe housing. Upper locking arm 102 may be positioned to extend from the top edge of the safe door and engage the safe housing. In order to position upper locking arm 102 in such a manner, secondary vertical locking plate 92 is positioned so that rods 44, 46 are situated at a lower portion of apertures 96, 98.

In order to allow access to the internal compartment of the safe housing, locking mechanism 10 may be moved to an unlocked position to disengage the locking pins 60 with the safe housing as best seen in FIG. 4. In moving locking mechanism 10 to an unlocked position, wheels 78 in tumblers stack 20 may be manipulated so that notches 80 are aligned with flange 76 on tail piece 18. This will allow flange 76 to move in such a manner to engage or be placed within notches 80.

With reference to FIGS. 1, 2 and 4, after notches 80 are aligned with flange 76, handle 32 is manipulated to rotate drive gears 22, 24, 26 in the direction indicated by arrow 110. The rotation of drive gears 22, 24, 26 causes live bolt lock plate 14, primary vertical lock plate 16, tail piece 18 and secondary vertical lock plate 92 to move relative to one another thereby disengaging locking pins 60 from the safe housing. In particular, the rotation of drive gear 24 and the meshed connection between its teeth 28 and the teeth 35 formed in live bolt lock plate 14 cause live bolt lock plate 14 to move in the direction indicated by arrow 112. As live bolt lock plate 14 is in motion, rods 44, 46, 48, 50 slide within apertures 36, 38, 40, 42 to guide live bolt lock plate 14 along a predetermined path. Additionally, the orientation of slot 52 may cause guide pin 54 to slide within slot 52 as live bolt lock plate 14 moves in direction 112. As a result of live bolt lock plate 14 moving in direction 112, locking pins 60 also move in the same direction due to their connection with side locking bar 58 whereby locking pins 60 are disengaged with the safe housing.

As drive mechanism 12 is rotated in direction 110, the meshed connection between teeth 28 on drive gear 22 and teeth 66 cause primary vertical lock plate 16 to move in the direction indicated by arrow 114. The movement of primary vertical lock plate 16 in direction 114 is guided by rods 48, 50 sliding toward the bottom portion of apertures 62, 64, respectively. Furthermore, guide pin 54 slides towards the upper portion of slot 52. Primary vertical lock plate 16 is permitted to move in direction 114 because flange 76 moves into the aligned notches 80 of tumbler wheels 78. With additional reference to FIG. 1, the movement of primary vertical lock plate 16 in direction 114 may also move lower locking arm 72 to move in the same direction thereby disengaging a locking pin from the safe housing at the bottom of the safe door.

As best seen in FIGS. 1 and 4, drive mechanism 12 may also be used to disengage the top portion of the safe door from the safe housing. Specifically, as drive mechanism 12 rotates in direction 110, the meshed connection between teeth 28 of drive gear 26 and teeth 94 causes secondary vertical lock plate to move in the direction indicated by arrow 116. As secondary vertical lock plate 92 moves in direction 116, apertures 96, 98 and rods 44, 46 guide secondary vertical lock plate 92 along a predetermined path. Due to the connection between secondary vertical locking plate 92 and upper locking arm 102, the locking pin that is located at the upper edge of the safe door is disengaged with the safe housing.

At this point, all of the locking pins are disengaged with the safe housing and the safe door may be opened to allow access to the interior compartment of the safe housing. In order to return locking mechanism 10 back to a locked position, handle 32 and drive mechanism 12 may be rotated opposite of direction 110 causing the live bolt lock plate 14, primary vertical lock plate 16, tail piece 18 and secondary vertical lock plate 92 to move back to the positions shown in FIG. 3 to engage the locking pins with the safe housing. The notches 80 in tumbler stack 20 may then be misaligned to prevent the handle 32 and the drive mechanism 12 from being used to access the safe.

The present invention overcomes or ameliorates the drawbacks and deficiencies in the prior art. In particular, the present invention attempts to reduce unauthorized access to the interior compartment of a safe by providing a slot and guide pin mechanism for slidably coupling the live bolt lock plate with the primary vertical lock plate. The guide pin and slot connection between the live bolt lock plate and the primary vertical lock plate is used in the present invention, at least in part, to provide a connection point between the live bolt lock plate and the primary vertical lock plate in addition to the connection established between the plates by the drive mechanism.

The locking mechanism of the present invention is directed to reducing the chance of unauthorized entry through the manipulation of the drive mechanism. For instance, if the drive mechanism is displaced so that it is no longer connected to both the live bolt lock plate and the primary vertical lock plate, the plates will still be required to move with respect to one another due to the connection between the guide pin and the slot. As best seen in FIG. 3, if the drive mechanism is entirely taken out of the locking mechanism and the live bolt lock plate is moved in direction 114, the force imposed on the live bolt lock plate would force the guide pin to move within the slot. Due to the orientation and positioning of the slot, the guide pin and the plate would move upwardly to a position shown in FIG. 4. Therefore, regardless of whether the gear mechanism is used in the present invention, movement in either the live bolt lock plate or the primary vertical lock plate will cause movement in the opposite plate due to the slot and guide pin mechanism of the present invention. As a result, the primary vertical lock plate and the tumbler stack, or any other type of combination or keyed locking system, may not be bypassed by simply manipulating the drive mechanism.

While particular embodiments of the invention have been shown, it will be understood, of course, that the invention is not limited thereto, since modifications may be made by those skilled in the art, particularly in light of the foregoing teachings. Reasonable variation and modification are possible within the scope of the foregoing disclosure of the invention without departing from the spirit of the invention.

What is claimed is:

1. A locking mechanism for an enclosure, the enclosure having a door and a housing, the locking mechanism comprising:

a drive mechanism for moving the locking mechanism between locked and unlocked positions;

a first plate engaged with the drive mechanism for selectively engaging the door with the housing;

a second plate engaged with the drive mechanism;

a rod mounted to the door, wherein an aperture is formed in one of the first and second plates to slidably receive the rod; and a tumbler stack associated with the second plate for selectively allowing the second plate to move to the unlocked position, wherein the first and second plates are slidingly coupled to one another, wherein one of the first and second plates has a slot defined therein, and the other plate has a guide piece mounted thereon that is slidingly received in the slot, wherein the slot is positioned at an angle relative to the aperture, and wherein the movement of one of the plates causes movement of the other plate irrespective of the connection of the first and second plates to the drive mechanism.

2. The locking mechanism as recited in claim 1, wherein the guide piece is a pin.

3. The locking mechanism as recited in claim 1, wherein the slot is positioned at an angle of about 45 degrees relative to the aperture.

4. The locking mechanism as recited in claim 1, wherein the slot is defined in the first plate and the guide piece is mounted to the second plate.

5. The locking mechanism as recited in claim 1, wherein a handle is coupled with the drive mechanism.

6. The locking mechanism as recited in claim 1, wherein the first plate is coupled with at least one locking pin for selectively engaging the door with the housing.

7. The locking mechanism as recited in claim 1, further comprising a tail piece coupled with the second plate and being associated with the tumbler stack to selectively allow the second plate to move to the unlocked position.

8. The locking mechanism as recited in claim 1, wherein the tumbler stack is coupled with a combination lock.

9. The locking mechanism as recited in claim 1, wherein the tumbler stack is coupled with a keyed lock.

10. The locking mechanism as recited in claim 1, wherein the aperture is a first aperture formed in the first plate, further comprising a second aperture formed in the second plate, wherein the rod is slidably received in the first and second apertures.

11. A locking mechanism for an enclosure, the enclosure having a door and a housing, the locking mechanism comprising:

a drive mechanism for moving the locking mechanism between locked and unlocked positions, the drive mechanism includes first and second gears;

a first plate engaged with the drive mechanism for selectively engaging the door with the housing;

a second plate engaged with the drive mechanism, wherein the first gear is coupled with the first plate and the second gear is coupled with the second plate; and a tumbler stack associated with the second plate for selectively allowing the second plate to move to the unlocked position, wherein the first and second plates are slidingly coupled to one another, wherein the movement of one of the plates causes movement of the other plate irrespective of the connection of the first and second plates to the drive mechanism.

12. The locking mechanism as recited in claim 11, wherein the drive mechanism includes a third gear that is coupled with a third plate, wherein the second and third locking plates are each coupled with at least one locking pin for selectively engaging the door with the housing.

13. A locking mechanism for an enclosure, the enclosure having a door and a housing, the locking mechanism comprising:

a drive mechanism for moving the locking mechanism between locked and unlocked positions;

a first plate engaged with the drive mechanism for selectively engaging the door with the housing;

a second plate engaged with the drive mechanism;

a tumbler stack associated with the second plate for selectively allowing the second plate to move to the unlocked position; and a tail piece coupled with the second plate and being associated with the tumbler stack to selectively allow the second plate to move to the unlocked position, wherein the tail piece includes an extension plate and an engagement flange, wherein the first and second plates are slidingly coupled to one another, wherein the movement of one of the plates causes movement of the other plate irrespective of the connection of the first and second plates to the drive mechanism.

14. A locking mechanism for an enclosure, the enclosure having a door and a housing, the locking mechanism comprising:

a drive mechanism for moving the locking mechanism between locked and unlocked positions;

a live bolt lock plate engaged with the drive mechanism and having a slot defined therein;

a primary lock plate engaged with the drive mechanism and having a guide pin mounted thereon, wherein said guide pin is slidingly positioned within the slot;

a rod mounted to the door; and a tumbler stack associated with the primary lock plate for selectively allowing the primary locking plate to be moved to the unlocked position, wherein an aperture is formed in one of the live bolt lock plate and the primary lock plate, wherein the aperture is sized to slidably receive the rod, and wherein the slot is positioned at an angle relative to the aperture.

15. The locking mechanism as recited in claim 14, wherein the slot is positioned at an angle of about 45 degrees relative to the aperture.

16. The locking mechanism as recited in claim 14, wherein the live bolt lock plate is coupled with at least one locking pin for selectively engaging the door with the housing.

17. The locking mechanism as recited in claim 14, furthering comprising a tail piece coupled with the primary lock plate and associated with the tumbler stack to selectively allow the primary lock plate to move to the unlocked position.

18. The locking mechanism as recited in claim 14, wherein the tumbler stack is coupled with a combination lock.

19. The locking mechanism as recited in claim 14, wherein the tumbler stack is coupled with a keyed lock.

20. The locking mechanism as recited in claim 14, wherein the aperture is a first aperture formed in the live bolt lock plate, further comprising a second aperture formed in the primary lock plate, wherein the rod is slidably received in the first and second apertures.

21. A locking mechanism for an enclosure, the enclosure having a door and a housing, the locking mechanism comprising:

a drive mechanism for moving the locking mechanism between locked and unlocked positions, wherein the drive mechanism includes first and second gears;

a live bolt lock plate engaged with the drive mechanism and having a slot defined therein;

a primary lock plate engaged with the drive mechanism and having a guide pin mounted thereon, wherein said guide pin is slidingly positioned within the slot, wherein the first gear is coupled with the live bolt lock plate and the second gear is coupled with the primary lock plate; and a tumbler stack associated with the primary lock plate for selectively allowing the primary locking plate to be moved to the unlocked position.

22. The locking mechanism as recited in claim 21, wherein the drive mechanism includes a third gear that is coupled with a secondary lock plate, wherein the primary and secondary lock plate are each coupled with at least one locking pin for selectively engaging the door with the housing.

23. A locking mechanism for an enclosure, the enclosure having a door and a housing, the locking mechanism comprising:

a drive mechanism for moving the locking mechanism between locked and unlocked positions;

a live bolt lock plate engaged with the drive mechanism and having a slot defined therein;

a primary lock plate engaged with the drive mechanism and having a guide pin mounted thereon, wherein said guide pin is slidingly positioned within the slot;

a tumbler stack associated with the primary lock plate for selectively allowing the primary locking plate to be moved to the unlocked position; and a tail piece coupled with the primary lock plate and associated with the tumbler stack to selectively allow the primary lock plate to move to the unlocked position, wherein the tail piece includes an extension plate and an engagement flange.

24. A locking mechanism for a safe, the safe having a door and a housing, the locking mechanism comprising:

a drive mechanism for moving the locking mechanism between locked and unlocked positions, the drive mechanism having first and second gears;

a live bolt lock plate engaged with the first gear of the drive mechanism and having at least one locking pin mounted thereto for selectively engaging the door and the housing, the live bolt lock plate having a slot defined therein;

a primary lock plate engaged with the second gear of the drive mechanism, the primary lock plate having a guide pin mounted thereon, wherein said guide pin is slidingly positioned within the slot;

a tail piece having an extension plate and an engagement flange, the extension plate coupled with the primary lock plate, the engagement flange coupled with the extension plate; and a tumbler stack associated with the engagement flange for selectively allowing the primary locking plate to be moved to the unlocked position, wherein the live bolt lock plate and the primary lock plate are slidingly coupled to one another, wherein the movement of one of the plates causes movement of the other plate irrespective of the connection of the live bolt lock plate and the primary lock plate to the drive mechanism.

25. The locking mechanism as recited in claim 24, further comprising a rod mounted to the door, wherein an aperture is formed in one of the live bolt lock plate and the primary lock plate, wherein the aperture is sized to slidably receive the rod, and wherein the slot is positioned at an angle relative to the aperture.

26. The locking mechanism as recited in claim 25, wherein the slot is positioned at an angle of about 45 degrees relative to the aperture.

27. The locking mechanism as recited in claim 24, wherein the drive mechanism includes a third gear that is coupled with a secondary lock plate, wherein the primary and secondary lock plate are each coupled with at least one locking pin for selectively engaging the door with the housing.

28. The locking mechanism as recited in claim 24, wherein the tumbler stack is coupled with a combination lock.

29. The locking mechanism as recited in claim 24, wherein the tumbler stack is coupled with a keyed lock.

30. A locking mechanism for an enclosure, the enclosure having a door and a housing, the locking mechanism comprising:

a drive mechanism for moving the locking mechanism between locked and unlocked positions;

a first plate engaged with the drive mechanism for selectively engaging the door with the housing;

a second plate engaged with the drive mechanism;

a rod mounted to the door, wherein an aperture is formed in one of the first and second plates to slidably receive the rod; and a lock associated with the second plate for selectively allowing the second plate to move to the unlocked position, wherein the first and second plates are slidingly coupled to one another, wherein one of the first and second plates has a slot defined therein, and the other plate has a guide piece mounted thereon that is slidingly received in the slot, wherein the slot is positioned at an angle relative to the aperture, and wherein the movement of one of the first and second plates causes movement of the other plate irrespective of the connection of the first and second plates to the drive mechanism.

31. The locking mechanism as recited in claim 30, wherein the lock is a tumbler stack.

32. The locking mechanism as recited in claim 30, wherein the aperture is a first aperture formed in the first plate, further comprising a second aperture formed in the second plate, wherein the rod is slidably received in the first and second apertures.

33. The locking mechanism as recited in claim 32, wherein the first aperture is positioned perpendicular to the second aperture.

34. The locking mechanism as recited in claim 30, wherein the slot is positioned at an angle of about 45 degrees relative to the aperture.

35. The locking mechanism as recited in claim 30, wherein the drive mechanism includes first and second gears, wherein the first gear is coupled with the first plate and the second gear is coupled with the second plate.

* * * * *